US009062401B2

(12) United States Patent
Matsushima et al.

(10) Patent No.: US 9,062,401 B2
(45) Date of Patent: Jun. 23, 2015

(54) METHOD OF SEWING A FASTENER STRINGER

(75) Inventors: Haruo Matsushima, Toyama (JP); Koji Ito, Toyama (JP); Tetsuya Yoshino, Toyama (JP); Seiji Koga, Toyama (JP)

(73) Assignee: YKK Corporation (JP)

( * ) Notice: Subject to any disclaimer, the term of this patent is extended or adjusted under 35 U.S.C. 154(b) by 313 days.

(21) Appl. No.: 13/515,390

(22) PCT Filed: Dec. 25, 2009

(86) PCT No.: PCT/JP2009/071561

§ 371 (c)(1),
(2), (4) Date: Jun. 12, 2012

(87) PCT Pub. No.: WO2011/077543

PCT Pub. Date: Jun. 30, 2011

(65) Prior Publication Data

US 2012/0246889 A1 Oct. 4, 2012

(51) Int. Cl.

| | |
|---|---|
| ***D05B 29/12*** | (2006.01) |
| ***D05B 35/06*** | (2006.01) |
| ***A41H 37/00*** | (2006.01) |
| *A41H 37/06* | (2006.01) |

(52) U.S. Cl.

CPC ..... *D05B 35/064* (2013.01); *Y10T 24/2588* (2015.01); *A41H 37/003* (2013.01); *A41H 37/06* (2013.01)

(58) Field of Classification Search

CPC ..... D05B 29/12; D05B 35/064; D05B 3/18
USPC ..... 112/475.04, 475.06, 475.14, 475.16
See application file for complete search history.

(56) References Cited

U.S. PATENT DOCUMENTS

| | | | | |
|---|---|---|---|---|
| 2,073,380 | A * | 3/1937 | Roseman | 24/408 |
| 2,079,834 | A * | 5/1937 | Blumenkrantz | 112/105 |
| 2,576,324 | A * | 11/1951 | Wirt | 112/419 |

(Continued)

FOREIGN PATENT DOCUMENTS

| | | | |
|---|---|---|---|
| CN | 1805697 | A | 7/2006 |
| CN | 101535548 | A | 9/2009 |

(Continued)

OTHER PUBLICATIONS

International Search Report and Written Opinion, PCT International Application No. PCT/JP2009/071561, mailed Apr. 13, 2010.

(Continued)

*Primary Examiner* — Danny Worrell, Jr.
(74) *Attorney, Agent, or Firm* — Kilpatrick Townsend & Stockton LLP

(57) ABSTRACT

A method of sewing a fastener stringer includes the steps of conveying a fastener stringer and an attached body to a sewing section of a sewing machine in a state with the fastener stringer superposed on the attached body, and arranging an element guide section in the sewing section of the sewing machine, bending a fastener tape in a direction in which a tape bent section opens, guiding the element rows to the element guide section, and sewing the fastener tape to the attached body. Accordingly, the method enables a sewing line formed by a sewing thread to be disposed at a predetermined position and the fastener tape and the attached body to be easily and efficiently sewn together.

5 Claims, 7 Drawing Sheets

(56) References Cited

U.S. PATENT DOCUMENTS

| | | | | | |
|---|---|---|---|---|---|
| 2,776,635 | A | * | 1/1957 | Blumenkrantz | 112/105 |
| 2,977,904 | A | * | 4/1961 | Carmen | 112/105 |
| 3,003,444 | A | * | 10/1961 | Gary | 112/235 |
| RE25,945 | E | * | 12/1965 | Brenner | 112/151 |
| 3,251,326 | A | * | 5/1966 | Howell | 112/240 |
| 3,349,736 | A | * | 10/1967 | Howell | 112/235 |
| 3,511,199 | A | * | 5/1970 | Howell | 112/235 |
| 3,579,748 | A | * | 5/1971 | Chery | 24/396 |
| 3,618,547 | A | * | 11/1971 | Howell | 112/240 |
| 3,643,614 | A | * | 2/1972 | Gooderum | 112/240 |
| 3,680,510 | A | * | 8/1972 | Ebata | 112/235 |
| 3,735,718 | A | * | 5/1973 | Vizgirda et al. | 112/235 |
| 3,755,879 | A | * | 9/1973 | Cuckson | 29/408 |
| 4,069,780 | A | * | 1/1978 | Minami | 112/150 |
| 4,159,001 | A | * | 6/1979 | Doori | 112/150 |
| 4,187,791 | A | * | 2/1980 | Moertel | 112/475.16 |
| 4,321,880 | A | * | 3/1982 | Boser | 112/127 |
| 4,593,635 | A | * | 6/1986 | Boser et al. | 112/475.16 |
| 4,628,545 | A | * | 12/1986 | Metzler | 2/265 |
| 4,704,781 | A | * | 11/1987 | Frohlich | 29/408 |
| 4,996,933 | A | * | 3/1991 | Boser | 112/475.06 |
| 5,410,975 | A | * | 5/1995 | Dudek et al. | 112/113 |
| 5,806,450 | A | * | 9/1998 | Dudek et al. | 112/475.16 |
| 5,979,348 | A | * | 11/1999 | Yaguchi | 112/475.16 |
| 6,352,044 | B1 | * | 3/2002 | Peng | 112/222 |
| 6,792,883 | B2 | * | 9/2004 | Ashton | 112/475.01 |
| 7,448,643 | B2 | * | 11/2008 | Kuettner et al. | 280/728.3 |
| 2006/0282995 | A1 | * | 12/2006 | Liou | 24/389 |
| 2006/0290497 | A1 | | 12/2006 | Sugata | |

FOREIGN PATENT DOCUMENTS

| | | | | |
|---|---|---|---|---|
| EP | 1661478 | A1 | | 5/2006 |
| EP | 2078774 | A1 | | 7/2009 |
| JP | 51-95459 | | | 7/1976 |
| JP | 9-313219 | A | | 12/1997 |
| JP | 2006-015069 | | | 1/2006 |
| JP | 2006-247279 | | | 9/2006 |
| JP | 3152100 | | | 6/2009 |
| WO | 2005-018365 | A1 | | 3/2005 |
| WO | 2008/053558 | A1 | | 5/2008 |
| WO | WO 2008053558 | A1 | * | 5/2008 |
| WO | WO 2011077543 | A1 | * | 6/2011 |

OTHER PUBLICATIONS

International Search Report and Written Opinion, PCT International Application No. PCT/JP2009/071487, mailed Apr. 6, 2010.

* cited by examiner

METHOD OF SEWING A FASTENER STRINGER

This application is a national stage application of PCT/JP2009/071561 which is incorporated herein by reference.

TECHNICAL FIELD

The invention relates to a sewing method for sewing a fastener stringer to an attached body, a manufacturing method for manufacturing a fastener attached product from the attached body to which the fastener stringer is sewed by the sewing method, a fastener attached product which is obtained by the manufacturing method, and a sewing machine foot used in the sewing method.

BACKGROUND ART

Generally, a slide fastener is roughly classified into two kinds of typical types including a slide fastener of a normal type in which right and left engaged element rows are arranged and exposed in a tape surface side of a fastener tape, and a slide fastener of a concealed type in which the right and left engaged element rows can be concealed in such a manner as to be invisible from an outer side (a so-called concealed slide fastener). Among them, the concealed slide fastener is preferably used in the product such as the various clothes, shoes and the like, by taking advantage of not precluding a designability of the product with its concealment, and has further come to be used in a seat cover for a sitting seat of a motor vehicle, a train and the like, in recent years.

One example of the concealed slide fastener mentioned above is disclosed as one of embodiments in Japanese Patent Application Laid-Open No. 2006-247279 (Patent Document 1).

A concealed slide fastener 60 according to the Patent Document 1 has a pair of right and left fastener stringers 61, and a slider (not shown) which can open and close the right and left fastener stringers 61, as shown in FIG. 9.

Each of the right and left fastener stringers 61 is provided with a band-like fastener tape 62, and a continuous element 63 which is sewn to the fastener tape 62 by using a fixing thread 64. The fastener tape 62 has a tape main body portion 62*a*, a tape bent section 62*b* which is extended in a tape width direction from one side edge of the tape main body portion 62*a* and is bent in a U-shape, and an element attaching portion 62*c* which is further extended from the tape bent section 62*b* and to which the continuous element 63 is sewn.

The continuous element 63 has an engagement head 63*a*, upper and lower leg portions 63*b* and 63*c* which are extended from the engagement head 63*a*, and a connecting portion 63*d* which connects between the adjacent fastener elements. Further, the continuous element 63 is structured such that a concave portion 63*e* accommodating a fixing thread 64 is formed on an upper surface of the upper leg portion 63*b*, and a height from a lower surface of the lower leg portion 63*c* to the upper leg portion 63*b* is set to a predetermined condition.

According to the concealed slide fastener 60 of the Patent Document 1 mentioned above, it is possible to bring the tape bent sections 62*b* in the right and left fastener tapes 62 into close contact with each other at a time of engaging the right and left continuous elements 63. In accordance with this, it is possible to conceal the continuous element 63 by the right and left tape bent sections 62*b* which are brought into close contact with each other so as to make it invisible from an outer surface (an exposed surface) side of the concealed slide fastener 60. Accordingly, it is possible to prevent a design of the product from being affected by the continuous element 63.

Further, in the Patent Document 1, since the fixing thread 64 sewing the continuous element 63 to the fastener tape 62 is accommodated in the concave portion 63*e* formed in the upper leg portion 63*b* so as to be protected, it is possible to prevent the slider and the fixing thread 64 from being interfered at a time of sliding the slider. In accordance with this, it is possible to prevent a sliding performance of the slider from being lowered, and it is possible to prevent the fixing thread 64 from being worn or damaged by a sliding motion of the slider.

Note that, in the case that the concealed slide fastener 60 is attached to an attached body such as a seat cover or the like, the fastener tape 62 of the concealed slide fastener 60 and the fastener attaching portion of the attached body are sewn in such a manner that the product is arranged in an outer surface (an upper surface) side of the tape main body portion 62*a* of the fastener tape 62.

On the other hand, in Japanese Utility Model Publication No. 3152100 (Patent Document 2), there is disclosed a slide fastener in which a covering band is attached to right and left continuous elements.

A slide fastener 70 according to the Patent Document 2 has a pair of fastener stringers 71 in which a coil-shaped continuous element 73 is attached to a pair of right and left fastener tapes 72, a covering body 74 which is attached to an upper surface side of the right and left continuous elements 73, and a slider (not shown) which is slidably arranged along the right and left continuous elements 73, as shown in FIG. 10.

Each of the right and left fastener tapes 72 has a tape main body portion 72*a*, a tape bent section 72*b* which is bent in a U-shape, and an element attaching portion 72*c* to which the continuous element 73 is sewn. The continuous element 73 is sewn to the element attaching portion 72*c* of the fastener tape 72 by using a fixing thread 75, and has an engagement head, upper and lower leg portions and a connecting portion. The covering body 74 is sewn to the element attaching portion 72*c* together with the continuous element 73 by the fixing thread 75.

The slide fastener 70 of the Patent Document 2 mentioned above is different from the concealed slide fastener 60 as in the Patent Document 1, and the continuous element 73 is arranged in the outer portion side of the sealed tape bent section 72*b* in the right and left fastener tapes 72 in the case of being attached to the product such as a seat cover or the like.

Further, in that case that the slide fastener 70 with the covering band 74 mentioned above is attached to the attached product such as a seat cover or the like, the fastener tape 72 of the concealed slide fastener 70 and the attached body 76 are sewn in such a manner that the attached body 76 such as a skin member or the like which is bent in a U-shape is pinched into an inner side of the tape bent section 72*b* of the fastener tape 72.

Accordingly, in the slide fastener 70 of the Patent Document 2, since the covering band 74 is further attached to an upper surface side of the continuous element 73 which is arranged in the outer portion side than the tape bent section 72*b*, it is possible to conceal the continuous element 73 so as to be invisible from the external portion. Further, since the covering band 74 is arranged at a position which is higher than a surface of the attached body 76, it is possible to apply a three-dimensional decoration to the fastener attached product.

Note that, in the Patent Document 2, it is necessary to sew the tape main body portion 72*a* of the fastener tape 72 and the attached body 76 in a back surface side (a side concealed to an inner portion) of the fastener attached product, and also in a position which is closer to the tape bent section 72*b* of the fastener tape 72, by using a sewing thread 77, at a time of sewing the fastener tape 72 of the fastener stringer 71 to the attached body 76. However, a description of the sewing method is not given in detail in the Patent Document 2, and in order to perform the sewing as mentioned above by using a normal sewing machine, a complicated sewing work is needed.

PRIOR ART DOCUMENT

Patent Document

Patent Document 1: Japanese Patent Application Laid-Open No. 2006-247279

Patent Document 2: Japanese Utility Model No. 3152100

SUMMARY OF THE INVENTION

Problems to be Solved by the Invention

Conventionally, in the case that the slide fastener is used in the attached product such as the seat cover of the motor vehicle or the like, it has been general to use the concealed slide fastener 60 as in the Patent Document 1 which makes the element rows in the engaged state invisible from the external portion, for inhibiting the element rows from affecting the design of the product, and it can be thought that the continuous element 73 is concealed by the covering band 74 as in the Patent Document 2.

Note that, since the element rows which are used in the slide fastener and the sewing thread which sews the element rows can give various colors, it is possible to easily change the color of the element rows and the sewing thread depending on the design or the like of the attached product to which the slide fastener is attached.

Accordingly, attempts to apply a new design to the attached product, by sewing the slide fastener in such a manner as to intentionally expose the element rows to the outside without concealing the element rows, with respect to the attached product such as the seat cover or the like in which the concealed slide fastener has been frequently used in recent years.

On the other hand, in the case of sewing the fastener stringer to the attached body such as the skin member or the like, for example, by using the conventional sewing machine, in the sewing machine foot for the sewing machine which has been generally used conventionally, it is necessary to set a sewing position (a sewing line) sewing the fastener tape of the slide fastener and the attached body of the skin member or the like away from the element rows, on the basis of a shape of the sewing machine foot. Therefore, it has been hard to perform the sewing while making the attached body and the element rows close to each other.

Accordingly, in the case of sewing the slide fastener to the attached body in such a manner as to expose the element rows of the slide fastener to the outside as mentioned above, the fastener attached product which is obtained after sewing is structured such that not only the element rows are exposed to the outside, but also the fastener tape is necessarily exposed to the outside.

However, if the fastener tape of the slide fastener is exposed to the outside together with the element rows, the right and left attached bodies to which the slide fastener is attached are largely spaced from each other, and a step is formed between the attached body and the fastener tape, whereby there will be problems that an appearance of the fastener attached product becomes poor, and that a design of the product is rather degraded.

Accordingly, the invention is made by taking the conventional problem mentioned above into consideration, and its specific object is to provide a method for sewing a fastener stringer which sews a fastener stringer to an attached body in such a manner that a fastener attached product in which a fastener tape is concealed so as not to be exposed at the same time element rows are exposed, a manufacturing method for manufacturing a fastener attached product from an attached body to which the fastener stringer is sewn by the sewing method, a fastener attached product which can be obtained by the manufacturing method, and a sewing machine foot which is used in the sewing method.

Means for Solving the Problems

In order to achieve the object mentioned above, a method for sewing a fastener stringer provided by the invention is a method for sewing a fastener stringer, which as a basic structure, has a fastener tape which is provided with a tape bent section bent in a U-shape between a tape main body portion and an element attaching portion, and element rows attached to at least a first tape surface of the element attaching portion while protruding an engaged head outward from the tape bent section, to a sheet-like attached body by a sewing machine, being most mainly characterized in that the method includes the steps of making a second tape surface which is opposite to the first tape surface of the tape main body portion in the fastener stringer, and the element rows, face to a surface which is exposed to the outside of the attached body so as to superpose the fastener stringer on the attached body, conveying the fastener stringer and the attached body toward a sewing section of the sewing machine in a state in which the fastener stringer is superposed on the attached body, and with a groove-shaped element guide section capable of inserting the element rows, in the sewing section of the sewing machine, bending the fastener tape in a direction in which the tape bent section opens, guiding the element rows to the element guide section, and sewing the fastener tape to the attached body.

In this case, it is preferable that the method for sewing the fastener stringer according to the invention includes using a fastener stringer sewn to the first tape surface of the fastener tape in which the element rows are coil-shaped or zigzag-shaped continuous elements, as the fastener stringer.

It is preferable that the method for sewing the fastener stringer according to the invention includes sewing the fastener tape to the attached body while inserting the element rows into the element guide section in a posture of the upper and lower leg portions to be parallel to the attached body, in such a manner that an engagement head and a connecting portion of the element rows are opposed to a first side surface portion and a second side surface portion which are arranged in a depth direction of the element guide section.

Further, it is preferable that the method for sewing the fastener stringer according to the invention includes supporting the element rows by the second side surface portion at a time of inserting the element rows into the element guide section of the sewing machine, in which the second side surface portion is formed at a position which is more away from a sewing machine needle than the first side surface portion.

Further, it is preferable that the sewing method includes inclining the element rows at a predetermined angle with respect to the attached body, in such a manner that a position of the engagement head of the element rows becomes higher than the connecting portion, at a time of inserting the element rows into the element guide section of the sewing machine.

Further, a method of manufacturing a fastener attached product which is provided by the invention is most mainly characterized by including at least bending the attached body to which the fastener stringer is sewn by the method of sewing the fastener stringer having the structure mentioned above, along the tape bent section of the fastener tape, and constructing a slide fastener by attaching a slider to a pair of the right and left fastener stringers, whereby manufacturing the fastener attached product in which the slide fastener is attached to the attached body.

Further, according to the invention, it is possible to provide the fastener attached product which is manufactured by the method of manufacturing the fastener attached-product having the structure mentioned above, and in which the element rows are exposed to the outside.

Further, the fastener attached product which is provided by the invention is a fastener attached product, structured, as a basic structure, such that slide fasteners are sewn to right and left attached bodies which are bent in a U-shape, the slide fasteners have right and left fastener stringers in which element rows are attached to a fastener tape provided with a tape bent section which is bent in a U-shape between a tape main body portion and an element attaching portion, and a slider which is attached slidablly along the element rows, the element rows are arranged in at least a first tape surface side of the element attaching portion, in a state in which engagement heads of the element rows are protruded outward from the tape bent section of the fastener tape. The fastener attached product is most mainly characterized in that apart of the attached body is bent and accommodated in an inner side of the tape bent section in the fastener tape, the tape bent sections of the right and left fastener tapes come into close contact with each other at a time of engaging the right and left the element rows, and the element rows are arranged and exposed to the outside in a side which is exposed to the outside than the sealed right and left tape bent sections.

In this case, it is preferable that the element rows are coil-shaped or zigzag-shaped continuous elements, and are sewn to the first tape surface of the fastener tape.

Next, a sewing machine foot provided by the invention is, as a basic structure, a sewing machine foot used in a sewing machine sewing a fastener stringer having a fastener tape which is provided with a tape bent section bent in a U-shape between a tape main body portion and an element attaching portion, and element rows which are attached to at least a first tape surface of the element attaching portion while making an engagement head protrude outward from the tape bent section, to an attached body. The sewing machine foot is most mainly characterized in that a groove-shaped element guide section capable of inserting the element rows and a part of the fastener tape is formed along a direction in which the fastener stringer and the attached body are conveyed by the sewing machine, and that an inner wall surface of the element guide section has a first side surface portion which is opposed to an engagement head formed in one end portion of the element rows to be inserted within the element guide section, a second side surface portion which is opposed to an end portion in an opposite side to the engagement head of the element rows, and an upper surface portion which is arranged in a bottom portion side of the element guide section and connecting the first side surface portion and the second side surface portion.

In the sewing machine foot according to the invention, it is preferable that the element rows are coil-shaped or zigzag-shaped continuous elements, and are used in a sewing machine which sews the fastener stringer sewn to the first tape surface of the fastener tape to the attached body.

In the sewing machine foot according to the invention, it is preferable that the second side surface portion of the element guide section supports the element rows at a time of inserting the element rows. Further, it is preferable that the first side surface portion of the element guide section is formed deeper than the second side surface portion from a pressing surface of the sewing machine foot. Further, it is preferable that the first and second side surface portions of the element guide section are arranged and inclined at an angle which is equal to or more than 60 degrees and equal to or less than 85 degrees with respect to the pressing surface of the sewing machine foot.

Effect of the Invention

In the method of sewing the fastener stringer according to the invention, at a time of sewing the fastener stringer having the element rows to the attached body by using the sewing machine, first of all, the fastener stringer is superposed on the attached body by making the second tape surface of the tape main body portion in the fastener stringer and the element rows face the surface which is exposed to the outside of the attached body, and the fastener stringer and the attached body are conveyed toward the sewing section (the sewing machine foot) of the sewing machine, in a state in which the element rows are arranged between the element attaching portion of the fastener tape and the attached body.

In this case, since the groove-shaped element guide section capable of inserting the element rows is arranged in the sewing section of the sewing machine, the fastener tape is bent in the direction in which the tape bent section opens and the element rows are guided to the element guide section, at a time of conveying the fastener stringer and the attached body toward the sewing machine foot. Thereafter, the fastener tape is sewn to the attached body while inserting the element rows and a part of the fastener tape into the element guide section of the sewing machine.

The sewing method of the invention which sews the fastener stringer to the attached body as mentioned above enables a sewing line formed by a sewing thread to be disposed at a predetermined position and the tape main body of the fastener tape and the attached body to be easily and efficiently sewn together. Further, by bending the attached body along the tape bent section of the fastener tape after sewing the fastener stringer to the attached body, it is possible to expose the element rows to the external surface (the exposed surface) side, and also conceal the fastener tape by the element rows and the skin member so as to make it hard to be viewed or invisible, for example, in the case that the slide fastener is constructed by using the fastener stringer.

Note that, the element rows in the invention are constructed by the continuous element (for example, the coil element or the zigzag element), and the element rows are sewn to one surface of the fastener tape. As a result of this configuration, the element rows, being viewed as largely elevated from the tape surface (the first tape surface), can provide a fastener stringer with a good appearance.

In the sewing method according to the invention mentioned above, the fastener tape is sewn to the attached body while inserting the element rows within the element guide section in a posture (a laid posture) of upper and lower leg portions to be parallel to the attached body, in such a manner that the engagement head of and the connecting portion of the element rows are opposed to the first side surface portion and the second side surface portion of the element guide section in the sewing section (the sewing machine foot) of the sewing machine. It is possible to stably and smoothly perform the sewing between the fastener tape and the attached body in such a manner that the sewing line is arranged at a predetermined position, by sewing the fastener tape to the attached body while inserting the element rows within the element guide section in the posture as mentioned above.

Note that, in the invention, the posture in which the upper and lower leg portions of the element rows are in parallel to the, attached body is an expression for understandably explaining a posture at a time when the element rows are inserted within the element guide section, and includes not only a case that the upper and lower leg portions are exactly in parallel to the attached body, but also a case that the upper and lower leg portions are inclined with respect to the attached body, however, an angle of incline is small (for example, equal to or less than 30 degrees) so that the upper and lower leg portions are substantially in parallel to the attached body.

Further, in the sewing method according to the invention, the second side surface portion is formed at a position which is more away from the sewing machine needle than the first side surface portion, and at a time of inserting the element rows into the element guide section of the sewing machine, the second side surface portion of the same element guide section supports the element rows. As a result of this configuration, it is possible to stably insert the element rows into the element guide section, whereby it is possible to stabilize the position of the sewing line so as to smoothly perform the sewing.

Further, in the invention, the element rows are inclined at a predetermined angle with respect to the attached body, in such a manner that the position of the engagement head of the element rows becomes higher than the connecting portion, at a time of inserting the element rows into the element guide section of the sewing machine.

In the invention, the fastener tape is bent in the direction in which the tape bent section opens, and the element rows are guided to the element guide section, at a time of conveying the fastener stringer and the attached body toward the sewing machine foot as mentioned above. In accordance with this, when the element rows are inserted into the element guide section, a force in a direction of returning the tape bent section to the original bent state is applied to the fastener tape, and a reaction force to the force in the returning direction is applied to the element guide section into which the element rows are inserted.

In the case mentioned above, by inserting the element rows within the element guide section in a state of being inclined with respect to the attached body, it is possible to make the force in the direction of returning the tape bent section to the original bent state small, and the reaction force acting on the element guide section also small. In accordance with this, since the element guide section can reduce an influence of the reaction force, it is possible to stably insert the element rows while keeping in a predetermined posture, and it is possible to more stabilize the position of the sewing line which is formed by the sewing thread.

Next, in the method of manufacturing the fastener attached product which is provided by the invention, the attached body to which the fastener stringer is sewn by the method of sewing the fastener stringer mentioned above is bent along the tape bent section of the fastener tape. Further, the fastener attached product is manufactured by attaching the slider to a pair of right and left fastener stringers so as to construct the slide fastener.

In the method of manufacturing the fastener attached product according to the invention mentioned above, the tape bent sections in the right and left fastener tapes come into close contact with each other at a time of engaging the right and left element rows, and it is possible to easily and stably manufacture the fastener attached product in which the right and left element rows are arranged and exposed to the outside in the outer surface (the exposed surface) of the sealed tape bent section.

Further, in the fastener attached product according to the invention which is manufactured by the method of manufacturing the fastener attached product as mentioned above, the element rows can be arranged and exposed to the outside in the outer surface (the exposed surface) side of the sealed tape bent section at a time of engaging the right and left element rows. Further, since the fastener tape of the fastener attached product is arranged in the back surface side of the engaged right and left element rows and the back surface side of the skin member, it is possible to easily conceal so as to be hard to be viewed from the outside (the exposed surface side) or invisible. As a result of this configuration, it is possible to provide the fastener attached product with a new design attached and easily eliminate problems due to degradation in the appearance and design of the attached product which is caused by the exposure of the fastener tape.

Further, the fastener attached product according to the invention is structured such that the slide fastener is sewn to the U-shaped bent right and left attached bodies. In this case, the element rows of the slide fastener are arranged at least in the first tape surface side of the element attaching portion in a state in which the engagement head is protruded outward from the tape bent section of the fastener tape.

Further, in the fastener attached product, apart of the attached body is bent to the inner side of the tape bent section in the fastener tape so as to be accommodated, the tape bent sections of the right and left fastener tapes come into close contact with each other at a time of engaging the right and left element rows, and the element rows are arranged and exposed to the outside in the side which is exposed to the external portion than the sealed tape bent section.

In the fastener attached product according to the invention mentioned above, it is possible to make the fastener tape hard to be viewed from the outside or invisible by the engaged element rows and the attached body at a time of engaging the right and left element rows. In accordance with this, in the fastener attached product exposing the element rows provide the fastener attached product with different design from conventional products and can easily eliminate problems of the appearance and design which are caused by the exposure of the fastener tape.

In this case, since the element rows are the coil-shaped or zigzag-shaped continuous elements and are sewn to the first tape surface of the fastener tape, the element rows are viewed as elevated largely from the first tape surface, it is possible to improve the appearance of the fastener attached product.

Particularly, in the invention, it is possible to provide the fastener attached product which is excellent in the design, by making the fastener tape invisible or hard to be viewed, and setting the colors of the attached body and the element or the colors of the attached body and the sewing thread sewing the elements to the different colors.

Next, in the sewing machine foot according to the invention, the groove-shaped element guide section capable of inserting the element rows and a part of the fastener tape is formed along the conveying direction of the fastener stringer. Further, the inner wall surface of the element guide section has the first side surface portion which is opposed to the engagement head formed in one end portion of the element rows, the second side surface portion which is opposed to the end portion in the opposite side to the engagement head of the element rows, and the upper surface portion which is arranged in the bottom portion side of the element guide section and connects the first side surface portion and the second side surface portion.

According to the sewing machine foot of the invention mentioned above, it is possible to stably press the fastener tape of the fastener stringer in a state of bending in the direction in which the tape bent section opens, at a time of performing the sewing between the fastener stringer and the attached body, and it is possible to insert the element rows into the element guide section while retaining the element rows in the posture (the laid posture) in which the upper and lower leg portions are in parallel to the attached body, by the first and second side surface portions and the upper surface portion. In accordance with this, it is possible to easily and stably sew the fastener tape to the attached body in such a manner that the sewing line is disposed at a predetermined position.

In this case, the sewing machine foot according to the invention can be preferably used particularly with respect to the sewing machine in which the element rows are the coil-shaped or zigzag-shaped continuous elements, and the fastener stringer sewn to the first tape surface of the fastener tape is sewn to the attached body. In accordance with this, the fastener attached product after sewing, since the element rows are viewed as largely elevated from the first tape surface, can improve the appearance.

In the sewing machine foot according to the invention mentioned above, the second side surface portion of the element guide section supports the element rows at a time of inserting the element rows. In accordance with this, it is possible to stably insert the element rows into the element guide section, whereby it is possible to smoothly perform the sewing while stabilizing the position of the sewing line.

Further, in the sewing machine foot, the first side surface portion of the element guide section is formed deeper than the second side surface portion from the pressing surface of the sewing machine foot. As a result of this configuration, it is possible to reduce the force in the direction of returning the tape bent section to the original bent state, and it is possible to reduce the reaction force acting on the sewing machine foot, at a time of performing the sewing between the fastener stringer and the attached body while inserting the element rows within the element guide section. In accordance with this, the sewing machine foot can stably insert the element rows while keeping the element rows in a predetermined posture, and can more stabilize the position of the sewing line.

Further, in the sewing machine foot, the first and second side surface portions of the element guide section are arranged and inclined at an angle which is equal to or more than 60 degrees and equal to or less than 85 degrees, preferably at an angle which is equal to or more than 75 degrees and equal to or less than 80 degrees, with respect to the pressing surface of the sewing machine foot. Note that, in the invention, the angle of incline of the first and second side surface portions with respect to the pressing surface means an angle in an acute angle side of the first side surface portion or the second side surface portion with respect to the pressing surface.

It is possible to securely form the second side surface portion of the element guide section by setting the angle of incline of the first and second side surface portions with respect to the pressing surface to be equal to or more than 60 degrees. In accordance with this, it is possible to securely support the element rows by the second side surface portion, and it is possible to more stably retain the element rows in the predetermined posture by the first and second side surface portions and the upper surface portion.

On the other hand, it is possible to easily reduce the force in the direction of returning the tape bent section to the original bent state, at a time of inserting the element rows into the element guide section, by setting the angle of incline of the first and second side surface portions with respect to the pressing surface to be equal to or less than 85 degrees, and it is possible to easily reduce the reaction force acting on the sewing machine foot.

MODE FOR CARRYING OUT THE INVENTION

Preferable embodiments of the invention will be described in detail below with reference to examples and the drawings. Note that, the invention is not limited to the embodiments described below, but can be variously changed as long as they have substantially the same structure as the invention and achieve the same operational effects.

For example, in the following embodiments, the description is given of the case that a coil-shaped element corresponding to a continuous element is sewn as element rows to a fastener tape, however, the invention is not limited to this, but can employ a zigzag-shaped element as the continuous element instead of the coil-shaped element. Further, the element rows may be constructed by a plurality of elements of a synthetic resin material which is fixed to a fastener tape by an injection molding, instead of the continuous element. Further, in the following embodiments, the description is given of the case that a fastener attached product is a seat cover for a motor vehicle, however, the invention can be applied in the same manner to the other fastener attached products.

Figure 1:
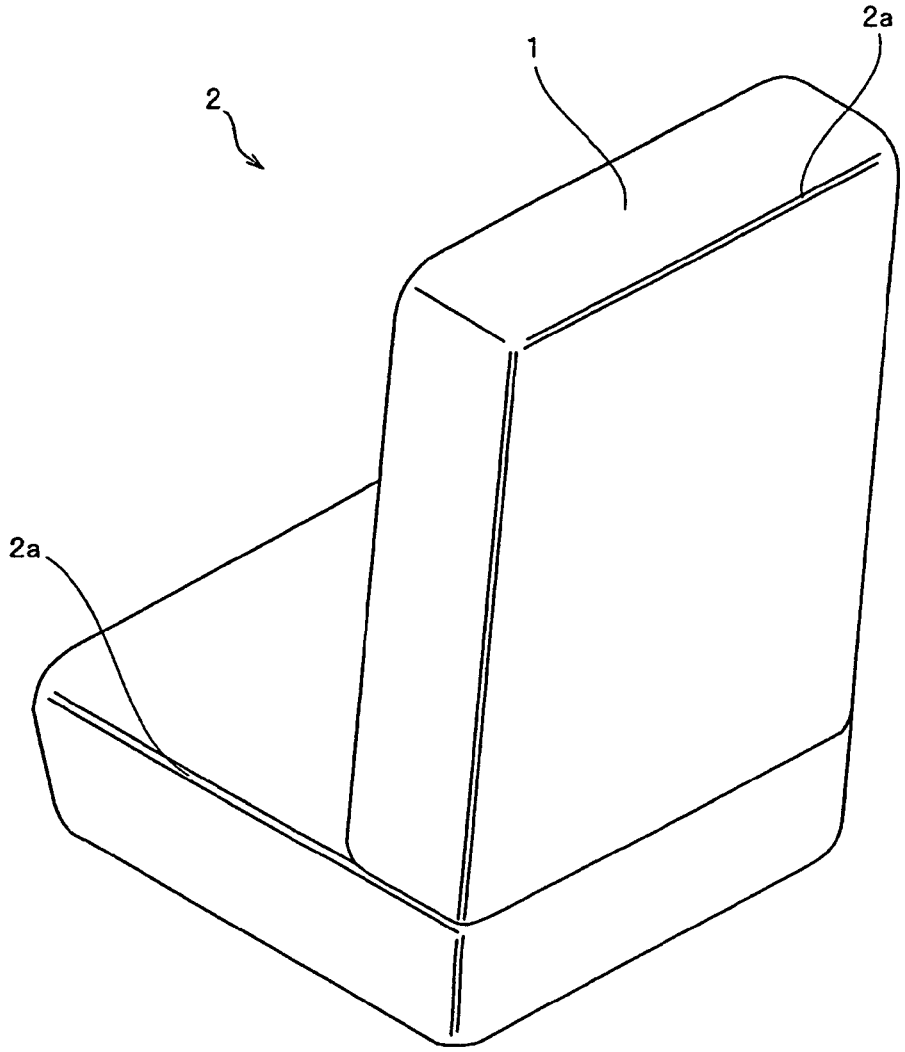
FIG. 1 is a perspective view showing a seat cover for a motor vehicle which is one of manners of use of a fastener attached product according to the invention.
Figure 2:
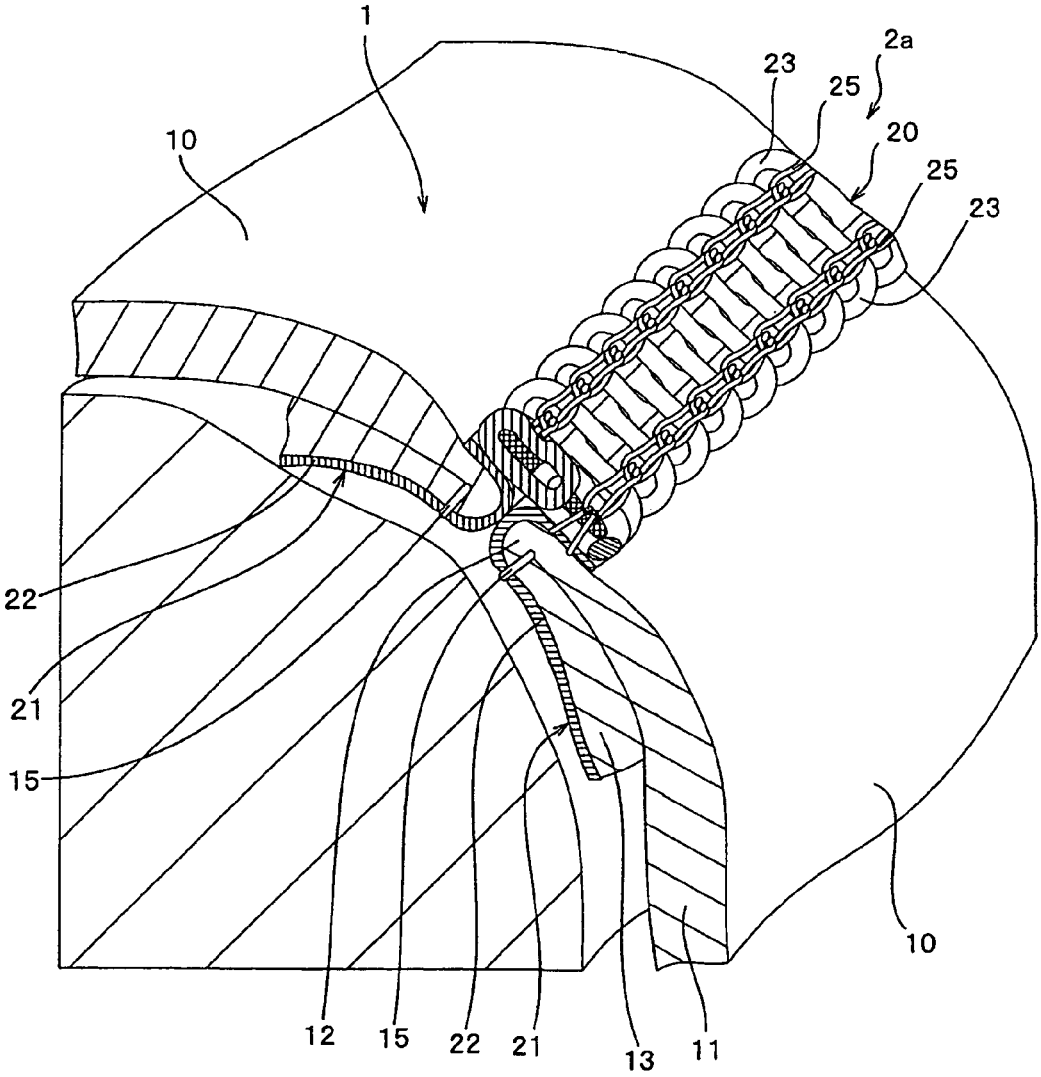
FIG. 2 is a cross-sectional perspective view showing a cross section in a substantial part of the seat cover in an enlarged manner.
Figure 3:
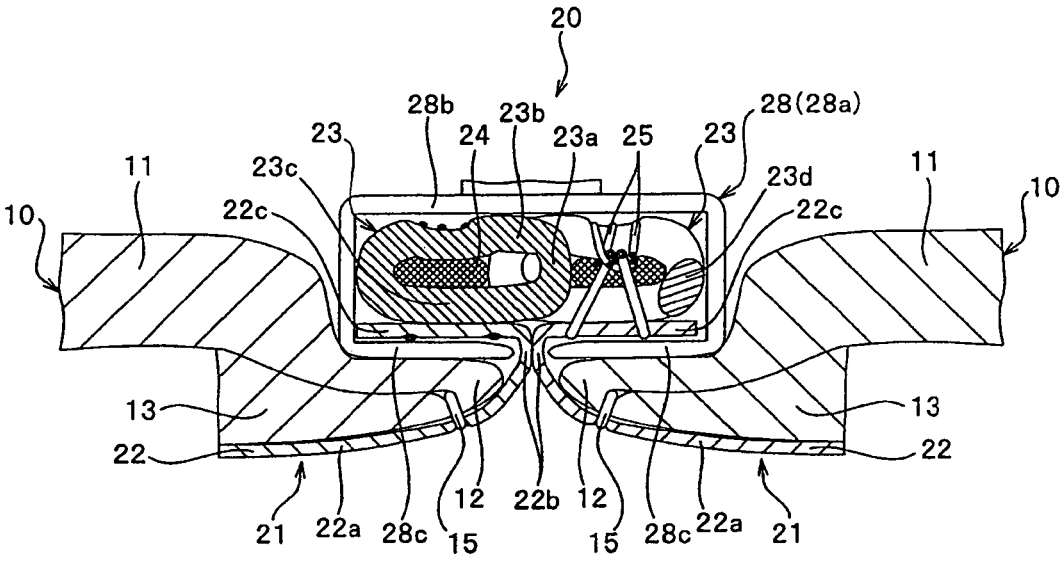
FIG. 3 is a cross-sectional view of a slide fastener which is attached to the seat cover.
Figure 4:
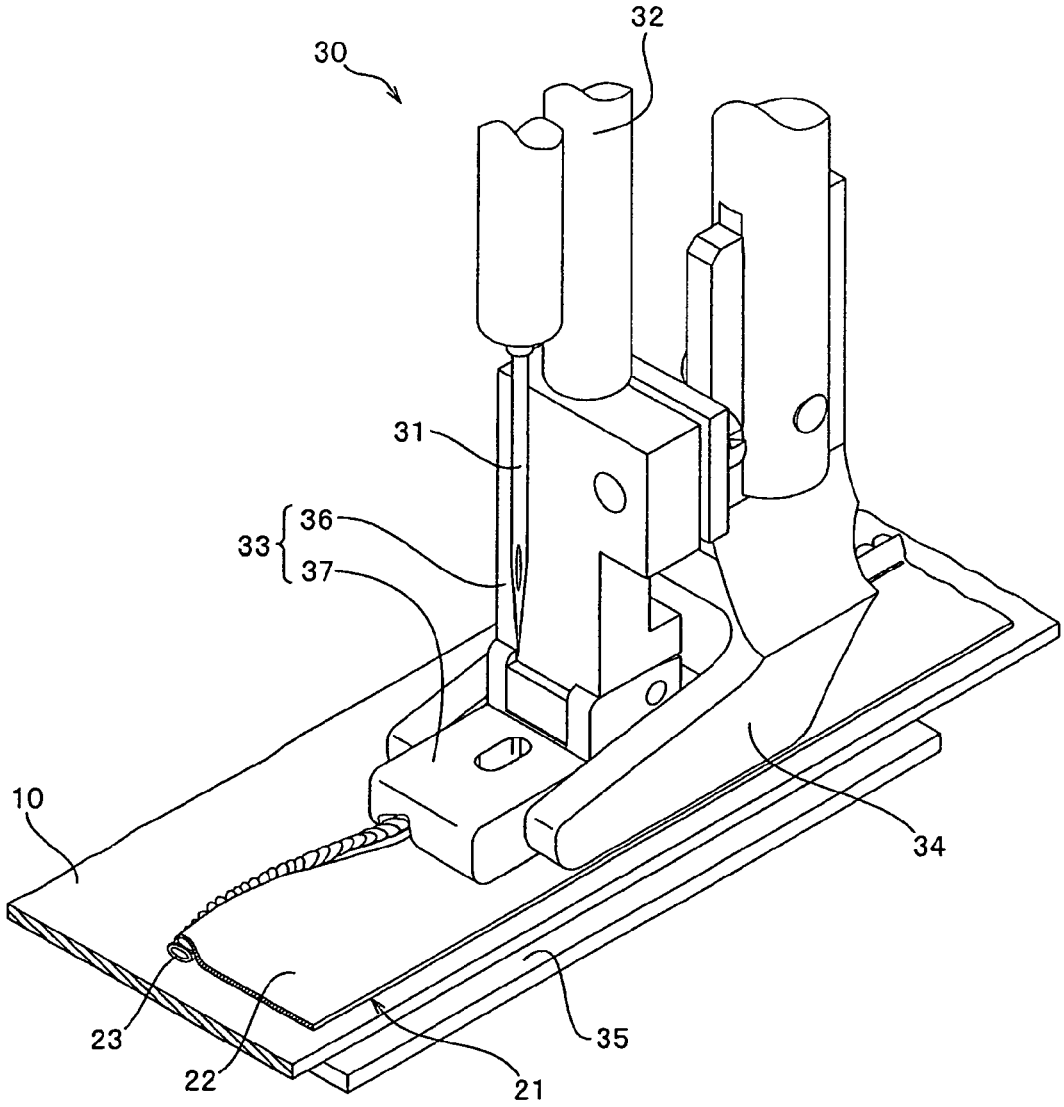
FIG. 4 is a perspective view of a substantial part showing a sewing section in a sewing machine which is provided with a sewing machine foot according to the invention in an enlarged manner.

Note that, FIG. 1 is a perspective view showing a seat cover for a motor vehicle as the fastener attached product according to the present embodiment. FIG. 2 is a cross-sectional perspective view showing a cross section of a substantial part of the seat cover in an enlarged manner. Further, FIG. 3 is a cross-sectional view of a slide fastener which is attached to the seat cover.

A seat cover 1 for a motor vehicle of the present embodiment is structured in such a manner as to be installed by covering on a surface of a cushion body 3 of a seat 2 for a motor vehicle, and has a plurality of sheet-like skin members 10 which cover the cushion body 3, and a slide fastener 20 which corresponds to a connecting portion 23*d* member connecting between the skin members 10.

Particularly, in the seat cover 1 according to the present embodiment, the slide fastener 20 is arranged at a position which corresponds to a ridge line portion 2*a* of the seat 2 for the motor vehicle, and a continuous element 23 mentioned below of the slide fastener 20 is arranged and exposed to the outside, along the ridge line portion 2*a* in which the slide fastener 20 is arranged.

In the seat cover 1 according to the present embodiment, a plurality of sheet-like skin members 10 which are cut in a predetermined shape are used as an attached body to which the slide fastener 20 is to be attached. Each of the skin members 10 has a cushion layer (not shown) which is made of a foamed polyurethane with an elasticity, is disposed in an inner side, and a skin layer (not shown) made of a synthetic resin, which is arranged in an outer surface (an exposed surface) side. Further, the skin member 10 is formed in such a manner as to have a thickness which is equal to or more than 2 mm and equal to or less than 10 mm as a whole of the cushion layer and the skin layer. Note that, in the invention, a material, a shape, a thickness and the like of the skin member 10 corresponding to the attached body are not particularly limited, but can be optionally changed as appropriate.

Further, the skin member 10 to which the slide fastener 20 is attached, as shown in FIGS. 2 and 3, has a main body portion 11 which covers a cushion body 3 and forms an exposed surface (an external surface), a bent section 12 which is extended from one side edge of the main body portion 11 and is bent in a U-shape in a side of the cushion body 3, and a fold-back portion 13 which is further extended from the bent section 12 and is arranged in a back surface side of the main body portion 11. In this case, the bent section 12 of the skin member 10 is bent in accordance with a bent state of a tape bent section 22*b* mentioned below of the fastener tape 22, and is retained in a state in which it gets into an inner side (an inner peripheral side) of the tape bent section 22*b* so as to be accommodated.

The slide fastener 20 which is used in the seat cover 1 of the present embodiment has a pair of right and left fastener stringers 21, and a slider 28 which can open and close the right and left fastener stringers 21. Further, each of the right and left fastener stringers 21 is provided with a band-shaped fastener tape 22, and coil-shaped continuous elements (element rows) 23 which are sewn to the respective right and left fastener tapes 22 by using a fixing thread 25.

The fastener tape 22 is a band-shaped body which is woven or knitted at a narrow width while having a first tape surface and a second tape surface. The fastener tape 22 has a tape main body portion 22*a* which is arranged between the skin member 10 and the cushion body 3, a tape bent section 22*b* which is extended from one side edge of the tape main body portion 22*a* and is bent in a U-shape, and an element attaching portion (a tape side edge portion) 22*c* which is extended from one side edge of the tape bent section 22*b* and in which a continuous element 23 is sewn to the first tape surface side.

Further, the fastener tape 22, as mentioned later, is sewn to the skin member 10 by sewing the tape main body portion 22*a* of the fastener tape 22 and the fold-back portion 13 of the skin member 10 by the sewing thread 15, and a sewing line (a stitch line) sewing the fastener tape 22 and the skin member 10 is formed by the sewing thread 15. In this case, the fastener tape 22 is arranged in such a manner as to cover the bent section 12 of the skin member 10.

Note that, in the invention, the sewing line (the sewing thread 15) sewing the fastener tape 22 and the skin member 10 can be formed within a region of the tape main body portion 22*a* and the tape bent section 22*b* in the fastener tape 22, and within a region of the fold-back portion 13 and the bent section 12 in the skin member 10. Particularly, in the present embodiment, in order to prevent the fastener tape 22 from being exposed to the outside, it is preferable that the sewing line is arranged in a region in the engagement head 23*a* side (an inner side) than a position of the tape main body portion 22*a* corresponding to the connecting portion 23*d* of the right and left continuous elements 23, in the case of viewing a transverse cross-sectional surface of the seat cover in a state of engaging the right and left continuous elements 23 (refer to FIGS. 2 and 3), and it is particularly preferable that the sewing line is arranged in a region in the engagement head 23*a* side (an inner side) than the position of the tape main body portion 22*a* corresponding to the tape end edge in the side of the element attaching portion 22*c* of the fastener tape 22.

The continuous element 23 constructing the element rows is formed by forming a monofilament made of a synthetic resin such as a polyester or the like into a coil shape. The continuous element 23 has an engagement head 23*a*, upper and lower leg portions 23*b* and 23*c* which are extended from the engagement head 23*a*, and a connecting portion 23*d* which connects an end portion of the upper leg portion 23*b* or the lower leg portion 23*c* to the lower leg portion 23*c* or the upper leg portion 23*b* of the adjacent fastener element.

The continuous element 23 is attached to the fastener tape 22 by sewing the upper and lower leg portions 23*b* and 23*c* to the element attaching portion 22*c* of the fastener tape 22 by a double ring sewing of a fixing thread 25 in a state in which the engagement head 23*a* is faced to the tape main body portion 11 of the band-shaped fastener tape 22, after inserting a core thread 24 between the upper and lower leg portions 23*b* and 23*c*.

Further, after the continuous element 23 is attached to the fastener tape 22, the fastener tape 22 is bent in the U-shape at the tape bent section 22*b* and a thermal set is applied to the fastener tape 22 in a bent form, whereby the engagement head 23*a* of the continuous element 23 comes to a state in which it protrudes outward from the tape bent section 22*b* of the fastener tape 22. As a result of this configuration, it is possible to engage the engagement heads 23*a* of the right and left continuous elements 23 to each other, and it is possible to bring the tape bent sections 22*b* of the right and left fastener tapes 22 into close contact with each other at a time of engaging the right and left continuous elements 23.

Further, in this case, since the continuous element 23 is sewn to the first tape surface in the element attaching portion 22*c* of the fastener tape 22, the continuous element 23 bulges largely with respect to the surface (the first tape surface) of the fastener tape 22.

The slider 28 used in the slide fastener 20 according to the present embodiment is provided with a slider body 28*a*, and a tab (not shown) which is retained rotatably in the slider body 28*a*.

Further, the slider body 28*a* has an upper blade 28*b*, flanges 28*c* which are provided in a hanging manner along right and left side edges of the upper blade 28*b* and have an inverted L-shaped cross section, a guide post (not shown) which is provided in a hanging manner downward from a center portion of a front end of the upper blade 28*b*, an element guide section (not shown) which is extended in a right and left direction from a lower end portion of the guide post, and a gantry tab attaching post (not shown) which is arranged on an upper surface of the upper blade 28*b* along a sliding direction of the slider 28.

The slide fastener 20 in the seat cover 1 of the present embodiment mentioned above is sewn to the skin member 10 by sewing the tape main body portion 22*a* of the fastener tape 22 to the fold-back portion 13 of the skin member 10 by using the sewing thread 15, in a state in which the second tape surface in the side in which the continuous element 23 of the fastener tape 22 is not arranged is aligned and faced with the surface in the side exposing to the outside of the skin member 10.

Further, since the skin member 10 is bent according to the bent state of the tape bent section 22*b* of the fastener tape 22 after sewing the fastener tape 22 to the skin member 10, the bent section 12 of the skin member 10 enters into the inner side (the inner peripheral side) of the tape bent section 22*b* of the fastener tape 22 so as to be accommodated.

In this case, the tape main body portion 22*a* of the fastener tape 22 and the fold-back portion 13 of the skin member 10 are directly sewn as mentioned above, and the other portions, for example, the element attaching portion 22*c* of the fastener tape 22 and the main body portion 11 of the skin member 10 are not sewn. Accordingly, the slider 28 can easily insert the right and left flanges 28*c* between the element attaching portion 22*c* and the skin member 10, thereby being attached to the right and left fastener stringers 21 so as to be slidable along the continuous element 23.

In the seat cover 1 of the present embodiment having the skin member 10 and the slide fastener 20 as mentioned above, the tape bent sections 22*b* of the right and left fastener tapes 22 come into close contact with each other at a time of engaging the right and left continuous elements 23 so as to close the slide fastener 20, and the right and left continuous elements 23 under the engaged state are arranged in the side which is exposed to the outside than the sealed right and left tape bent sections 22*b*.

Accordingly, in a state in which the slide fastener 20 is closed, the engaged right and left continuous elements 23 are exposed to the outside at a time of viewing the seat cover 1 from the external surface (the exposed surface) side. On the other hand, the right and left fastener tapes 22 can be concealed by the right and left continuous elements 23 and the right and left skin members 10 so as to be invisible (or hard to be viewed).

Next, a description will be given of a method of manufacturing the seat cover 1 according to the present embodiment.

First of all, one fastener stringer 21 in the slide fastener 20 is sewn to one skin member 10 by using the sewing machine 30. At this point, a description will be given of the sewing machine 30 which performs the sewing of the fastener stringer 21 and the skin member 10 with reference to FIGS. 4 to 8.

Note that, in the following description in the sewing machine 30, a direction in which the sewing machine needle 31 is thrust to the sewn subject (the fastener stringer 21 and the skin member 10) is defined as a downward direction, and a direction in which the sewing machine needle 31 is drawn out of the sewn subject is defined as an upward direction. Further, a direction in which the sewn subject is conveyed is defined as a rearward direction, and an opposite direction to it is defined as a forward direction. Further, a direction which is orthogonal to an up and down direction and a back and forth direction is defined as a lateral direction (or a width direction).

The sewing machine 30 used in the present embodiment has, in a sewing section of the sewing machine 30, the sewing machine needle 31 which is installed so as to be movable in the up and down direction and the back and forth direction, a presser bar 32 which moves while working with a movement of the sewing machine needle 31, a sewing machine foot (an inner pressing portion) 33 which is arranged in a lower end of the presser bar 32 and presses the sewn subject from the above, an outer pressing portion 34 which can press the sewn subject from the above instead of the sewing machine foot 33 at a time when the sewing machine foot 33 is held up, a throat plate 35 which mounts the sewn subject, and a downward feed portion (not shown) which is arranged within an opening (not shown) formed in the throat plate 35.

The sewing machine 30 is structured as a so-called ordinary feed sewing machine which can press the sewn subject by the sewing machine foot 33 and the downward feed portion (not shown) and can feed the sewn subject rearward together with the sewing machine needle 31, in a state in which the sewing machine needle 31 is thrust to the sewn subject, and the outer pressing portion 34 can press the sewn subject at a time when the sewing machine foot 33 and the downward feed portion (not shown) move forward.

Further, the sewing machine foot 33 installed to the sewing machine 30 has a fixed portion 36 which is fixed to the presser bar 32, a foot main body 37 which is axially attached to the fixed portion 36 so as to freely oscillate in the up and down direction, and an elastic member (not shown) which energizes the foot main body 37 downward toward a leading end.

Figure 5:
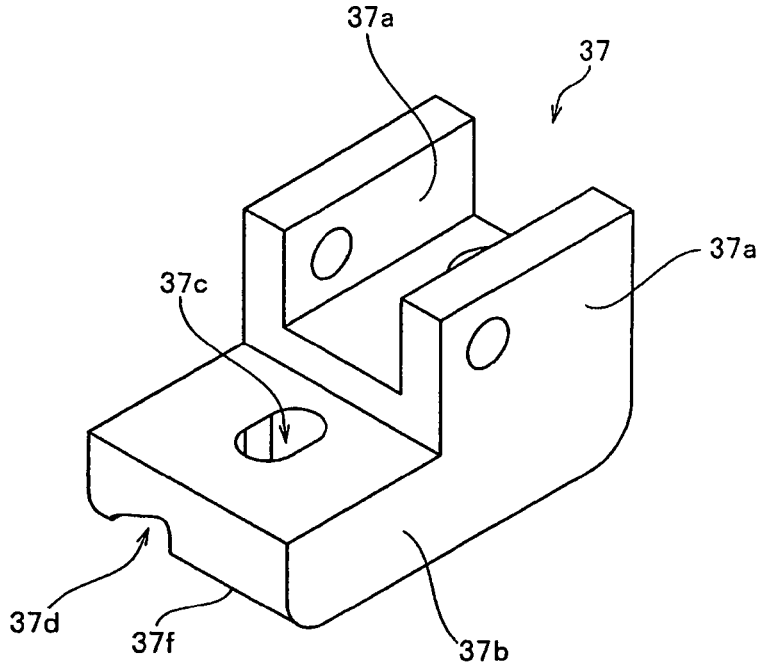
FIG. 5 is a perspective view in which the sewing machine foot is viewed from a diagonally upward direction.
Figure 6:
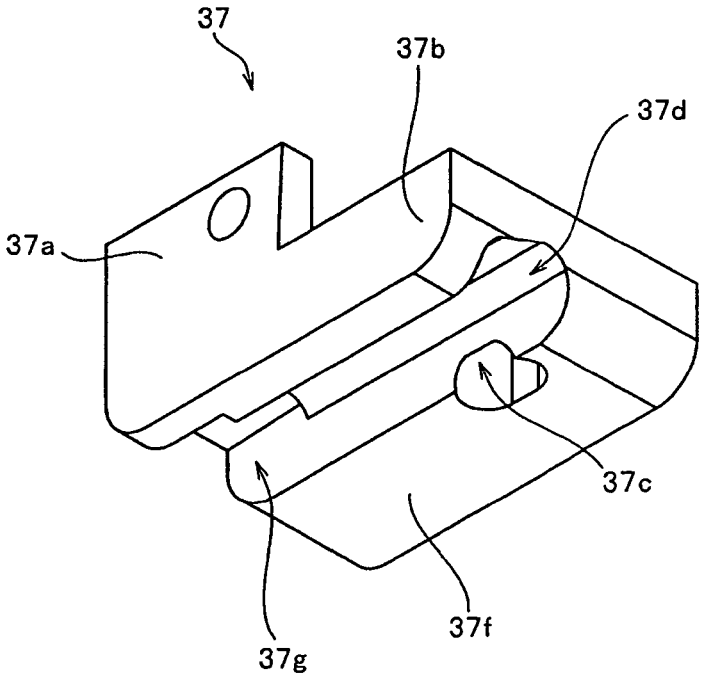
FIG. 6 is a perspective view in which the sewing machine foot is viewed from a diagonally downward direction.
Figure 7:
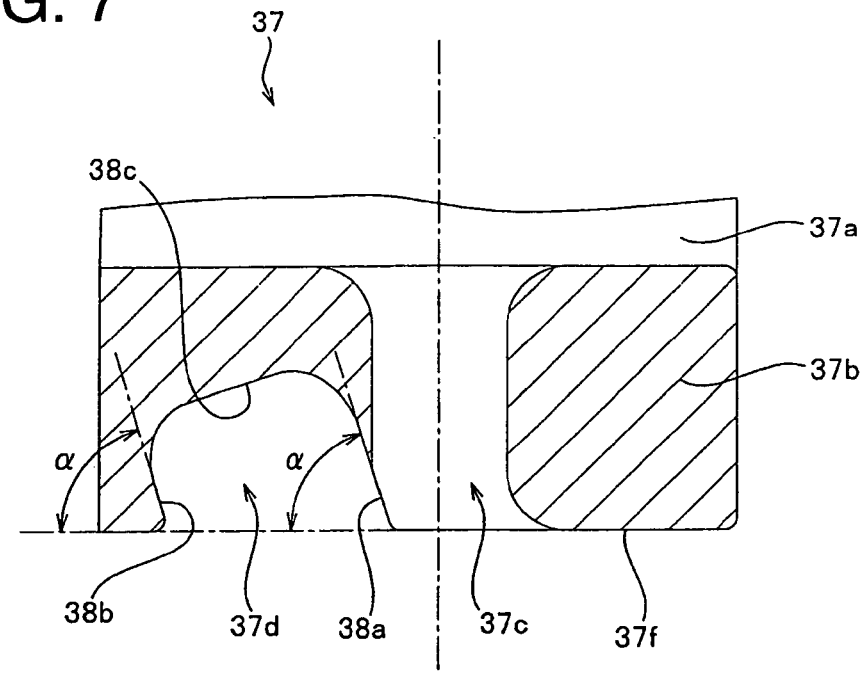
FIG. 7 is a cross-sectional view of the sewing machine foot.

The foot main body 37 in the sewing machine foot 33 is formed into an approximately L-shape, as shown in FIGS. 5 to 7, and has a base end portion 37*a* which is axially attached to the fixed portion 36, and a pressing portion 37*b* which is arranged in a lower end of the base end portion 37*a*. Further, a needle hole 37*c*, which passes through in the up and down direction (the thrusting direction of the sewing machine needle 31) and can allow the sewing machine needle 31 to be inserted, is formed in the pressing portion 37*b* of the foot main body 37.

Further, in the pressing portion 37*b*, an element guide section 37*d* which can insert the continuous element 23 of the fastener stringer 21 and a part of the fastener tape 22 is formed along a conveying direction (a back and forth direction) of the fastener stringer 21 and the, skin member 10 by the sewing machine 30.

In this case, the element guide section 37*d* is provided in a concave manner like a groove shape from a bottom surface 37*f* corresponding to a pressing surface of the pressing portion 37*b* toward a left diagonally upward direction at a time of viewing the foot main body 37 from the front side (refer to FIG. 7). Further, the element guide section 37*d* is arranged in a left side of the needle hole 37*c* in such a manner that a part of a lower end portion thereof superposes over a lower end portion of the needle hole 37*c*. Note that, a chamfer is applied to an end portion (a lower end portion) in a side of the bottom surface 37*f* in the element guide section 37*d*.

An inner wall surface of the element guide section 37*d* has first and second side surface portions 38*a* and 38*b* which are formed in a depth direction (a left diagonally upward direction) of the element guide section 37*d* from the bottom surface 37*f*, and an upper surface portion 38*c* which is formed in a bottom portion side of the element guide section 37*d*. Further, in an inner wall surface of the element guide section 37*d*, the first side surface portion 38*a* is arranged in a side of the needle hole 37*c* of the element guide section 37*d*, and the second side surface portion 38*b* is arranged in an opposite side to the needle hole 37*c* of the element guide section 37*d*.

In this case, the first side surface portion 38*a* and the second side surface portion 38*b* are arranged substantially in parallel, and the length (the depth) from the bottom surface 37*f* of the first side surface portion 38*a* is formed longer (deeper) than the length (the depth) from the bottom surface 37*f* of the second side surface portion 38*b*. Further, the first and second side surface portions 38*a* and 38*b* are arranged and inclined toward a departing direction from the needle hole 37*c* at an angle which is equal to or more than 60 degrees and equal to or less than 85 degrees (preferably, an angle which is equal to or more than 75 degrees and equal to or less than 80 degrees), with respect to the bottom surface 37*f* of the pressing portion 37*b*.

The upper surface portion 38*c* of the element guide section 37*d* is formed over an upper end of the second side surface portion 38*b* from an upper end of the first side surface portion 38*a*, and has right and left curved surface portions and a flat surface portion which is arranged between the right and left curved surface portions. In this case, a flat surface portion of the upper surface portion 38*c* is arranged and inclined at an angle which is equal to or more than 5 degrees and equal to or less than 30 degrees, with respect to the bottom surface 37*f* of the pressing portion 37*b*.

Further, in the present embodiment, a rear end portion (an end portion in an outlet side) of the element guide section 37*d* is formed wider than a front end portion. Specifically, in a rear end portion 37*g* of the element guide section 37*d*, the element guide section 37*d* is formed wider in a width direction and a depth direction by enlarging a distance between the first side surface portion 38*a* and the second side surface portion 38*b* via a step portion which is formed in the second side surface portion 38*b*, and increasing a dimension in a depth direction of the element guide section 37*d* via a step portion which is formed in the upper surface portion 38*c*.

Further, in the case of sewing the fastener stringer 21 and the skin member 10 by using the sewing machine 30 as mentioned above, to begin with, the fastener stringer 21 is superposed on the skin member 10 by making the second tape surface of the tape main body portion 22*a* of the fastener tape 22 in the first stringer 21 and the continuous element 23, and the surface exposed to the outside in the skin member 10 face to each other. At this time, the continuous element 23 is arranged between the element attaching portion 22*c* of the fastener tape 22 and the skin member 10.

Further, in a state in which the fastener stringer 21 is superposed on the skin member 10, the fastener stringer 21 and the skin member 10 are mounted on the throat plate 35 of the sewing machine 30 and conveyed toward the sewing machine foot 33. In this case, before starting the sewing by the sewing machine 30, in one end portion (a rear end portion) in the tape length direction of the fastener stringer 21, the tape main body portion 22*a* of the fastener tape 22 is pressed by the bottom surface 37*f* of the sewing machine foot 33, and the continuous element 23 and the element attaching portion 22*c* of the fastener tape 22 are introduced into the element guide section 37*d* of the sewing machine foot 33, while bending the fastener tape 22 in a direction in which the tape bent section 22*b* opens.

The fastener stringer 21 and the skin member 10 are fed rearward sequentially by the sewing machine foot 33 and the downward feed portion (not shown), after the rear end portion of the fastener stringer 21 is set in a state as mentioned above. According to this, the continuous element 23 and the element attaching portion 22*c* forcibly bends the fastener tape 22 in the direction in which the tape bent section 22*b* opens, in proportion to the continuous element 23 and the element attaching portion 22*c* which are antecedently introduced into the element guide section 37*d*, and the continuous element 23 and the element attaching portion 22*c* of the fastener tape 22 are guided to the element guide section 37*d* while sequentially rotating the continuous element 23 in such a manner that a relative positional relationship between the engagement head 23*a* and the connecting portion 23*d* is substantially in an opposite direction.

Note that, in the invention, the sewing section of the sewing machine 30 can be provided with a tape bending assisting portion which assists the bending of the fastener tape 22, in order to make it possible to more smoothly bend the fastener tape 22 at a time of guiding the continuous element 23 and the element attaching portion 22*c* to the element guide section 37*d*.

Since the continuous element 23 and the element attaching portion 22*c* are guided to the element guide section 37*d* as mentioned above, as shown in FIG. 8, the continuous element 23 smoothly enters into the element guide section 37*d* in a posture in which the engagement head 23*a* is opposed to the first side surface portion 38*a* of the element guide section 37*d*, the connecting portion 23*d* is opposed to the second side surface portion 38*b* of the element guide section 37*d*, and the upper leg portion 23*b* is opposed to the upper surface portion 38*c* of the element guide section 37*d*. Further, within the element guide section 37*d*, the continuous element 23 travels toward a rear side (a conveying direction of the fastener stringer 21 and the skin member 10) while maintaining the posture mentioned above.

At this time, the continuous element 23 is inserted into the element guide section 37*d* in a posture in which the upper and lower leg portions 23*b* and 23*c* are substantially in parallel to the surface of the skin member 10 in such a manner that the engagement head 23*a* is directed to a width direction with respect to the upper and lower leg portions 23*b* and 23*c*, while the connecting portion 23*d* and the end portion in the connecting portion 23*d* side in the upper leg portion 23*b* are supported by the second side surface portion 38*b* of the element guide section 37*d* and the curved portion in the side of the second side surface portion 38*b* in the upper surface portion 38*c*.

Further, the fastener stringer 21 and the skin member 10 are fed rearward while inserting the continuous element 23 and the element attaching portion 22*c* into the element guide section 37*d*, and the sewing machine needle 31 is reciprocated in an up and down direction in conformity to the feeding motion of the fastener stringer 21 and the skin member 10. In accordance with this, it is possible to easily and efficiently sew the fastener tape 22 of the fastener stringer 21 to the skin member 10 in such a manner that the sewing line formed by the sewing thread 15 is disposed at a predetermined position.

In this case, in the present embodiment, the first and second side surface portions 38*a* and 38*b* in the element guide section 37*d* are arranged and inclined at an angle which is equal to or more than 60 degrees and equal to or less than 85 degrees (preferably, an angle which is equal to or more than 75 degrees and equal to or less than 80 degrees) with respect to the bottom surface 37*f* of the pressing portion 37*b*, as mentioned above. In accordance with this, the continuous element 23 which is inserted into the element guide section 37*d* travels while keeping a posture in which the upper and lower leg portions 23*b* and 23*c* are substantially in parallel to the surface of the skin member 10, however, strictly speaking, travels while keeping a posture in which the upper end lower leg portions 23*b* and 23*c* are inclined at an angle, for example, which is equal to or more than 5 degrees and equal to or less than 30 degrees with respect to the surface of the skin member 10, in such a manner that the position of the engagement head 23*a* becomes higher than the position of the connecting portion 23*d*.

In this case, since an angle a of incline of the first and second side surface portions 38*a* and 38*b* with respect to the bottom surface 37*f* is set to be equal to or more than 60 degrees (preferably equal to or more than 75 degrees), it is possible to securely form the second side surface portion 38*b* of the element guide section 37*d* at a predetermined length (depth). In accordance with this, at a time of sewing the fastener stringer 21 and the skin member 10 while inserting the continuous element 23 into the element guide section 37*d*, it is possible to securely support the continuous element 23 by the second side surface portion 38*b*, and it is possible to feed the continuous element 23 rearward while stably keeping in the posture of being inclined at the predetermined angle, by the first and second side surface portions 38*a* and 38*b* and the upper surface portion 38*c*. In accordance with this, it is possible to prevent the sewing line formed by the sewing thread 15 from meandering and stably sew the fastener stringer 21 to the skin member 10.

Figure 8:
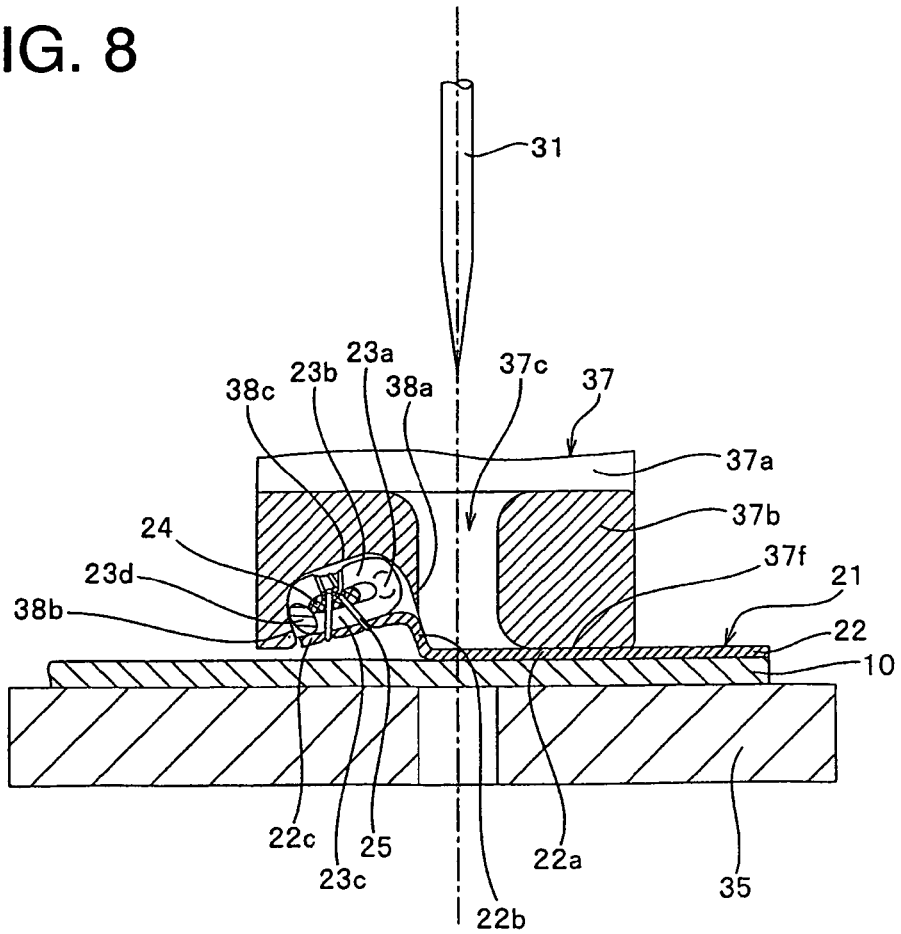
FIG. 8 is a cross-sectional view schematically showing a state of the sewing machine foot, a fastener stringer and an attached body at a time of sewing.
Figure 9:
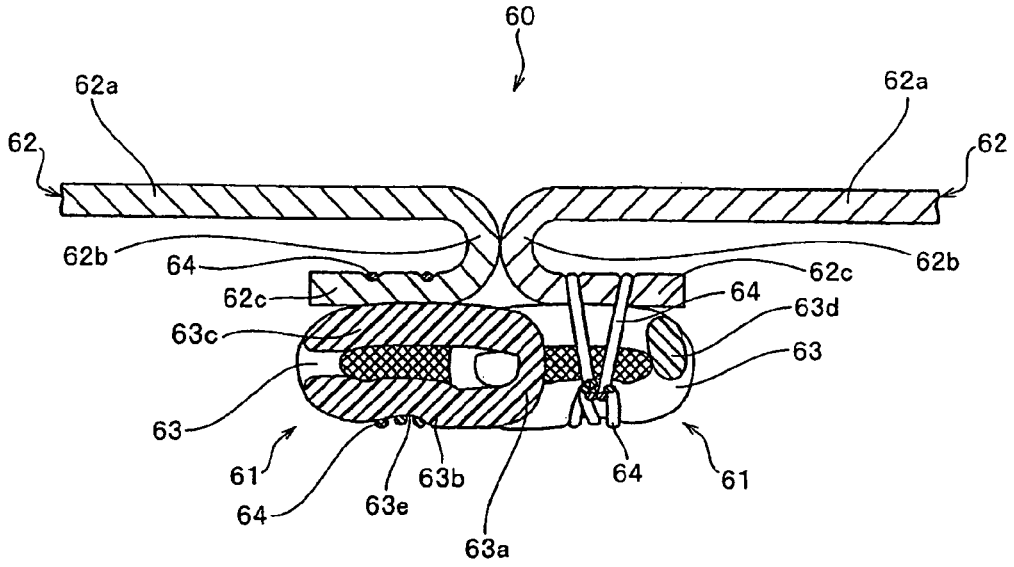
FIG. 9 is a cross-sectional view showing a conventional concealed slide fastener.
Figure 10:
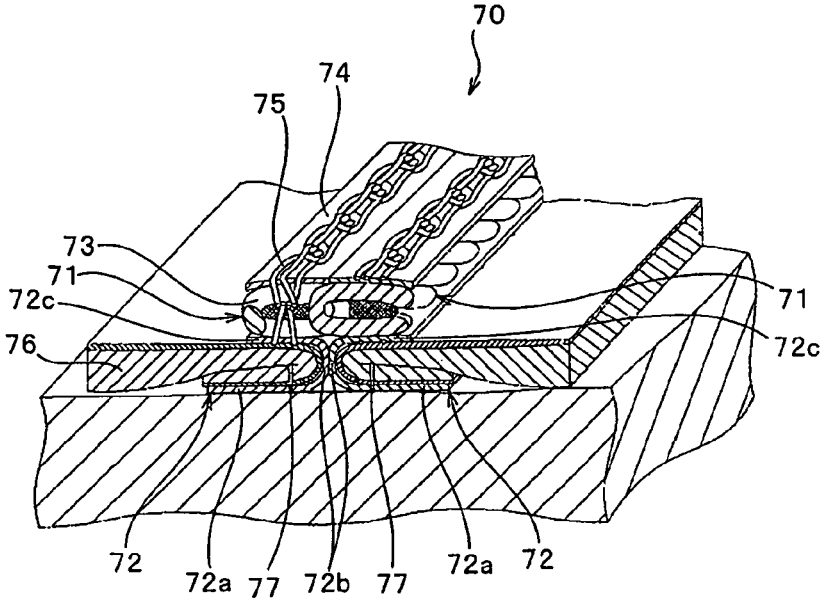
FIG. 10 is a cross-sectional perspective view showing a conventional slide fastener to which a covering body is attached.

On the other hand, as shown in FIG. 8, at a time of inserting the continuous element 23 into the element guide section 37*d*, the tape main body portion 11 is pressed by the pressing portion 37*b* of the sewing machine foot 33 in a state in which the tape bent section 22*b* is bent in an opening direction, and the fastener tape 22 inserts the element attaching portion 22*c* into the element guide section 37*d* so as to be conveyed rearward.

In this case, in the tape bent section 22*b* of the fastener tape 22, the bent form is fixed by the thermal set. In accordance with this, when the continuous element 23 is inserted to the element guide section 37*d*, a force in a direction of returning the tape bent section 22*b* to the original bent state acts on the fastener tape 22 itself, and a reaction force (a resistance force) corresponding to the force in the returning direction acts on the element guide section 37*d* into which the continuous element 23 is inserted.

In the case mentioned above, since the angle a of incline of the first and second side surface portions 38*a* and 38*b* with respect to the bottom surface 37*f* is set to be equal to or less than 85 degrees (preferably equal to or less than 80 degrees), it is possible to make an angle at which the tape bent section 22*b* opens smaller at a time of inserting the continuous element 23 into the element guide section 37*d*, and it is possible to reduce a resilient deforming amount of the fastener tape 22.

In accordance with this, it is possible to make the force in the direction of returning the tape bent section 22*b* to the original bent state smaller, and it is possible to make the reaction force acting on the sewing machine foot 33 smaller. Accordingly, since it is possible to stably insert the continuous element 23 rearward while keeping in the predetermined posture, it is possible to stably sew the fastener stringer 21 to the skin member 10 while forming the sewing line at the predetermined position, at a time of sewing the fastener stringer 21 and the skin member 10.

Note that, the continuous element 23 is inserted into the element guide section 37*d* even after the fastener tape 22 is sewn to the skin member 10, however, in the sewing machine foot 33 of the present embodiment, the rear end portion 37*g* of the element guide section 37*d* is formed wider in the width direction and the depth direction of the element guide section 37*d* than the front end portion.

In this case, since the tape bent section 22*b* is bent little by little in the direction of returning to the thermally set original bent state at a time when the continuous element 23 moves to the rear end portion along the element guide section 37*d*, it is possible to reduce the force which the continuous element 23 acts on the sewing machine foot 33, in the rear end portion of the element guide section 37*d*. Accordingly, it is possible to reduce a possibility of problems, for example, due to meandering of the sewing line or the like which is caused by a displacement of the position of the sewing machine foot 33, and it is possible to more stably sew the fastener stringer 21 to the skin member 10.

Further, after sewing the fastener stringer 21 to the skin member 10 over a whole in the length direction as mentioned above, the skin member 10 is bent according to the tape bent section 22*b* of the fastener tape 22. Further, in order to maintain the bent state of the skin member 10, a thermal set is applied to the skin member 10 as appropriate. In accordance with this, it is possible to retain the engagement head 23*a* of the continuous element 23 in the state of protruding outward from the tape bent section 22*b* of the fastener tape 22.

Thereafter, the fastener stringer 21 is sewn as mentioned above, the right and left U-shaped bent skin members 10 are combined as one set, and the slider 28 is slidably attached along the continuous element 23 of the combined fastener stringer 21. In accordance with this, the seat cover 1 mentioned above according to the present embodiment shown in FIGS. 1 to 4 can be obtained.

In the seat cover 1 according to the present embodiment obtained as mentioned above, the tape bent sections 22*b* of the right and left fastener tapes 22 come into contact with each other at a time of sliding the slider 28 so as to engage the right and left continuous elements 23 and close the slide fastener 20, and the right and left continuous elements 23 in the engaged state are arranged in the side which is exposed to the outside than the right and left tape bent sections 22*b* in contact.

Accordingly, the engaged right and left continuous elements 23 can be clearly exposed to the outside at a time of viewing the seat cover 1 from the external surface side. On the other hand, the right and left fastener tapes 22 can be concealed by the right and left continuous elements 23 and the right and left skin members 10 so as to be invisible (or hard to be viewed). Further, the seat cover 1 of the present embodiment can make the sewing line (the sewing thread 15) sewing the fastener tape 22 and the skin member 10 invisible from the outside.

Therefore, since the seat cover 1 of the present embodiment has a new design by exposing only the continuous element 23 to the external surface without exposing the fastener tape 22 as much as possible to the external surface, and can prevent the degradation in the appearance and design which is caused by the exposure of the fastener tape 22 and the sewing line, for example, it is possible to give a commercial value which has not been provided conventionally to the seat 2 for the motor vehicle. Further, it is possible to provide a product with an excellent design by changing colors of the continuous element 23 and the fixing thread 25 with respect to the skin member 10.

Further, the slider 28 in the seat cover 1 is structured such that the right and left flanges 28*c* are inserted between the element attaching portion 22*c* and the skin member 10 so as to be attached to the right and left fastener stringers 21. In accordance with this, a sliding performance of the slider 28 is improved, and it is possible to easily and smoothly carry out an opening and closing operation of the slide fastener 20.

Note that, in the embodiment mentioned above, in the case of sewing the fastener stringer 21 to the skin member 10, the sewing machine foot 33 of the invention is installed to the total feed sewing machine 30 as mentioned above, and the sewing between the fastener stringer 21 and the skin member 10 is performed. However, the invention is not limited to this, but the sewing of the fastener stringer 21 and the skin member 10 can be performed, for example, by installing the sewing machine foot 33 of the invention to a sewing machine which is called as a so-called up and down feed sewing machine.

DESCRIPTION OF REFERENCE NUMERALS

1 seat cover
2 seat for motor vehicle
2*a* ridge line portion
3 cushion body
10 skin member
11 main body portion
12 bent section
13 fold-back portion
15 sewing thread
20 slide fastener
21 fastener stringer
22 fastener tape
22*a* tape main body portion
22*b* tape bent section
22*c* element attaching portion
23 continuous element (element rows)
23*a* engagement head
23*b* upper leg portion
23*c* lower leg portion
23*d* connecting portion
24 core thread
25 fixing thread
28 slider
28*a* slider body
28*b* upper blade
28*c* flange
30 sewing machine
31 sewing machine needle
32 presser bar
33 sewing machine foot
34 outer pressing portion
35 throat plate
36 fixed portion
37 foot main body
37*a* base end portion
37*b* pressing portion
37*c* needle hole
37*d* element guide section
37*f* bottom surface
37*g* rear end portion
38*a* first side surface portion
38*b* second side surface portion
38*c* upper surface portion
α angle of incline

The invention claimed is:

1. A method of sewing a fastener stringer to an attached body using a sewing machine, wherein the fastener stringer has a fastener tape with a tape main body portion, an element attaching portion, and a tape bent section, wherein the tape bent section is bent in a U-shape and is between the tape main body portion and the element attaching portion, and an element row is attached to at least a first tape surface of the element attaching portion and an engagement head protrudes outward from the tape bent section, wherein the method includes the steps of:

placing the fastener stringer on an external surface of the attached body so that a portion of a second tape surface faces the external surface of the attached body, wherein the second tape surface is on an opposite side of the fastener tape from the first tape surface and the portion of the second tape surface corresponds to the tape main body portion;

conveying the fastener stringer and the attached body toward a sewing section of the sewing machine; and feeding the fastener stringer into an element guide groove in the sewing section, wherein the element guide groove opens the tape bent section so that the second tape surface of the element guide section faces the external surface of the attached body, and sewing the fastener tape to the attached body.

2. The method of sewing a fastener stringer according to claim 1, wherein the method includes a step of providing a fastener stringer in which the element row includes coil-shaped or zigzag-shaped continuous elements.

3. The method of sewing a fastener stringer according to claim 2, wherein the continuous elements comprise the engagement head, a pair of upper and lower leg portions that extend from the engagement head, and a connecting portion that connects adjacent fastener elements, and wherein the step of feeding the fastener stringer into an element guide groove in the sewing section positions the pair of upper and lower leg portions in parallel to the attached body so that the connecting portion is opposed to a first side surface portion of the element guide groove and the engagement head is opposed to a second side surface portion of the element guide groove, wherein the first and second side surface portions are arranged in a depth direction of the element guide groove.

4. The method of sewing a fastener stringer according to claim 3, wherein the method includes a step of supporting the element row by the second side surface portion when the element row is inserted into the element guide groove of the sewing machine, wherein the second side surface portion is formed at a position farther away from a sewing machine needle than the first side surface portion.

5. The method of sewing a fastener stringer according to claim 3, wherein the method includes a step of inclining the element row at a predetermined angle with respect to the attached body, in such a manner that a position of the engagement head of the element row is higher than the connecting portion, when the element row is inserted into the element guide groove of the sewing machine.

* * * * *

UNITED STATES PATENT AND TRADEMARK OFFICE

CERTIFICATE OF CORRECTION

PATENT NO. : 9,062,401 B2
APPLICATION NO. : 13/515390
DATED : June 23, 2015
INVENTOR(S) : Matsushima et al.

It is certified that error appears in the above-identified patent and that said Letters Patent is hereby corrected as shown below:

In the specification

Column 5, line 27, delete “slidablly” and insert -- slidably --, therefor.

Column 8, line 31, delete “apart” and insert -- a part --, therefor.

Column 17, line 4, delete “a” and insert -- α --, therefor.

Column 17, line 39, delete “a” and insert -- α --, therefor.

Signed and Sealed this
Sixteenth Day of August, 2016

Michelle K. Lee

Michelle K. Lee
*Director of the United States Patent and Trademark Office*